US005357678A

United States Patent [19]

Wei

[11] Patent Number: 5,357,678

[45] Date of Patent: Oct. 25, 1994

[54] SCISSOR WITH RETRACTABLE CUTTING BLADES

[76] Inventor: Chih-Yeng Wei, No.1, Lane 30, Sec.3, Je-Ho Rd., Pei-Tun Dist., Taichung City, Taiwan

[21] Appl. No.: 194,428

[22] Filed: Feb. 10, 1994

[51] Int. Cl.[5] ..... B26B 13/00

[52] U.S. Cl. ..... 30/255; 30/162

[58] Field of Search ..... 30/255, 254, 252, 154, 30/162

[56] References Cited

U.S. PATENT DOCUMENTS

| | | | |
|---|---|---|---|
| 4,502,220 | 3/1985 | Aoki | 30/162 |
| 4,715,121 | 12/1987 | Sugiyama et al. | 30/162 |
| 4,791,725 | 12/1988 | Amagaya | 30/255 |
| 4,794,692 | 1/1989 | Wang | 30/162 |

FOREIGN PATENT DOCUMENTS

| | | |
|---|---|---|
| 112662 | 4/1876 | France . |
| 128657 | 1/1879 | France . |
| 1079 | of 1877 | United Kingdom . |
| 17785 | of 1887 | United Kingdom . |
| 15859 | of 1904 | United Kingdom . |

*Primary Examiner*—Richard K. Seidel
*Assistant Examiner*—Hwei-Siu Payer
*Attorney, Agent, or Firm*—Cushman, Darby & Cushman

[57] ABSTRACT

A scissor includes a pair of handles and a pair of cutting blades. Each of the handles is formed with a recess that extends longitudinally at the inner portion from the front end of the handle to a point adjacent the rear end of the same. The handles are connected pivotally at the front end. The cutting blades are in superposed contact with each other when the scissor is closed. The cutting blades are connected pivotally adjacent to rear ends thereof and can be retracted into the recesses of the handles. A slide unit is connected to the cutting blades and is operated so as to extend or retract the cutting blades into the recesses. The slide unit engages one of first and second rounded protrusions on the handles to retain releasably and selectively the cutting blades in the fully extended and fully retracted positions. A spring unit is provided in the recess of each handle to bias the cutting blades toward each other in order to close automatically the scissor after a cutting operation has been accomplished.

3 Claims, 7 Drawing Sheets

SCISSOR WITH RETRACTABLE CUTTING BLADES

BACKGROUND OF THE INVENTION

1. Field of the Invention

The invention relates to a scissor, more particularly to a scissor with retractable cutting blades.

2. Description of the Related Art

French Patent 128657 discloses a scissor with a pair of loop handles, each of which being formed with a recess that extends longitudinally at the inner portion from the front end of the loop handle to a point adjacent the rear end of the same and being connected pivotally at the front end. The scissor further has a pair of cutting blades in superposed contact with each other when the scissor is closed. The cutting blades are connected pivotally adjacent to rear ends thereof and are capable of being retracted into the recesses of the loop handles. This patent, however, does not disclose means for retaining releasably and selectively the cutting blades in the fully extended and fully retracted positions. Moreover, the scissor of this patent is unable to move the cutting blades toward each other in order to close automatically the same after a cutting operation has been accomplished.

SUMMARY OF THE INVENTION

Therefore, the main objective of the present invention is to provide a scissor with a pair of pivotally connected loop handles, a pair of pivotally connected cutting blades that can be retracted into longitudinal recesses formed in the inner portions of the loop handles, and means for retaining releasably and selectively the cutting blades in the fully extended and fully retracted positions.

Another objective of the present invention is to provide a scissor with means for moving the cutting blades toward each other in order to close automatically the scissor after a cutting operation has been accomplished.

Accordingly, the scissor of the present invention comprises:

a pair of handles, each of which having a front end, a rear end, and a substantially straight inner portion formed with a recess which extends longitudinally from the front end to a point adjacent the rear end and a retaining unit which is formed in the recess, the retaining unit including a longitudinal guide projection which defines a longitudinal rail groove in the recess, the rail groove having a wider portion adjacent to the front end, the inner portions of the handles facing each other and being formed with a respective pair of pivot ears on the front end, the pivot ears of one of the handles being superposed on the pivot ears of the other one of the handles, each of the handles further having opposite sides provided with a respective first rounded protrusion adjacent to the rear end;

a pair of connecting pins, each of which connecting pivotally one of the pivot ears on one of the handles and one of the pivot ears on the other one of the handles to connect pivotally the handles at the front end, each of the connecting pins having a head portion formed with a second rounded protrusion;

a pair of cutting blades in superposed contact with each other when the scissor is closed, the cutting blades being retractable into the recesses of the handles and being formed with aligned pivot holes adjacent to rear ends thereof, each of the cutting blades having a dull edge and being formed with an anchor projection at the rear end thereof, the anchor projection extending slidably into the rail groove of a respective one of the handles;

a hollow blade connector extending into the pivot holes of the cutting blades to connect pivotally the cutting blades;

a slide unit including two slide pieces, each of which resting slidably on a corresponding one of the opposite sides of the handles, one of the slide pieces being formed with a tubular projection, the other one of the slide pieces having a shaft projection which extends between the inner portions of the handles and through the blade connector and which is received fittingly in the tubular projection, each of the slide pieces having an inner side formed with an annular groove, the slide unit being movable between a first position, wherein the annular grooves receive removably the first rounded protrusions on the handles and the cutting blades are retracted into the recesses of the handles, and a second position, wherein the annular grooves receive removably the second rounded protrusions of the connecting pins and the cutting blades are extended from the recesses of the handles; and a pair of spring units, each of which being received in the wider portion of the rail groove in a respective one of the handles and having a curved end section which abuts against the dull edge of a respective one of the cutting blades to bias the cutting blades toward each other.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
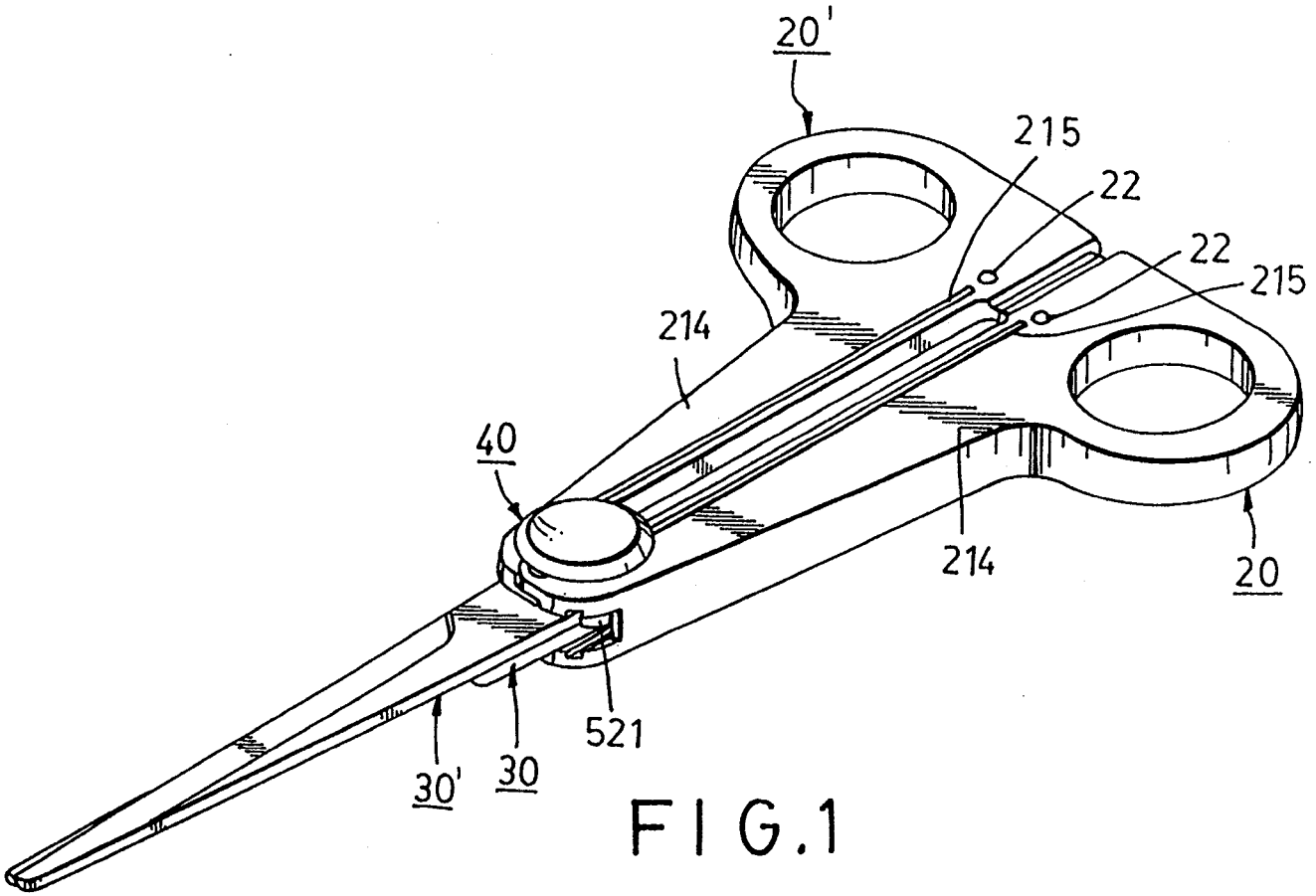
FIG. 1 is a perspective view of the preferred embodiment of a scissor with retractable cutting blades according to the present invention.
Figure 2:
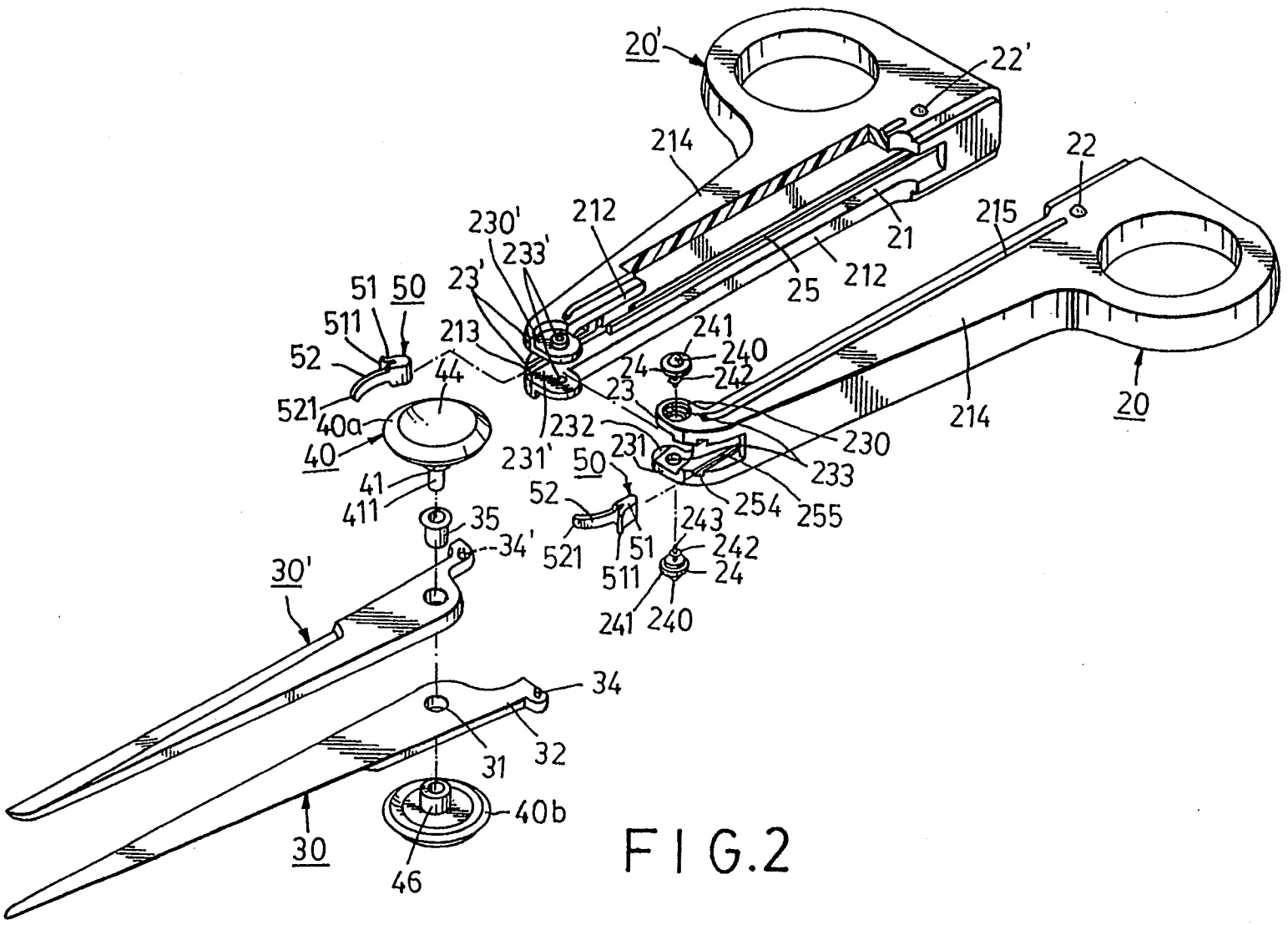
FIG. 2 is an exploded view of the preferred embodiment.

Referring to FIGS. 1 and 2, the preferred embodiment of a scissor according to the present invention is shown to comprise a pair of loop handles 20, 20' a pair of cutting blades 30, 30' a slide unit 40, and a pair of spring units 50.

Figure 3:
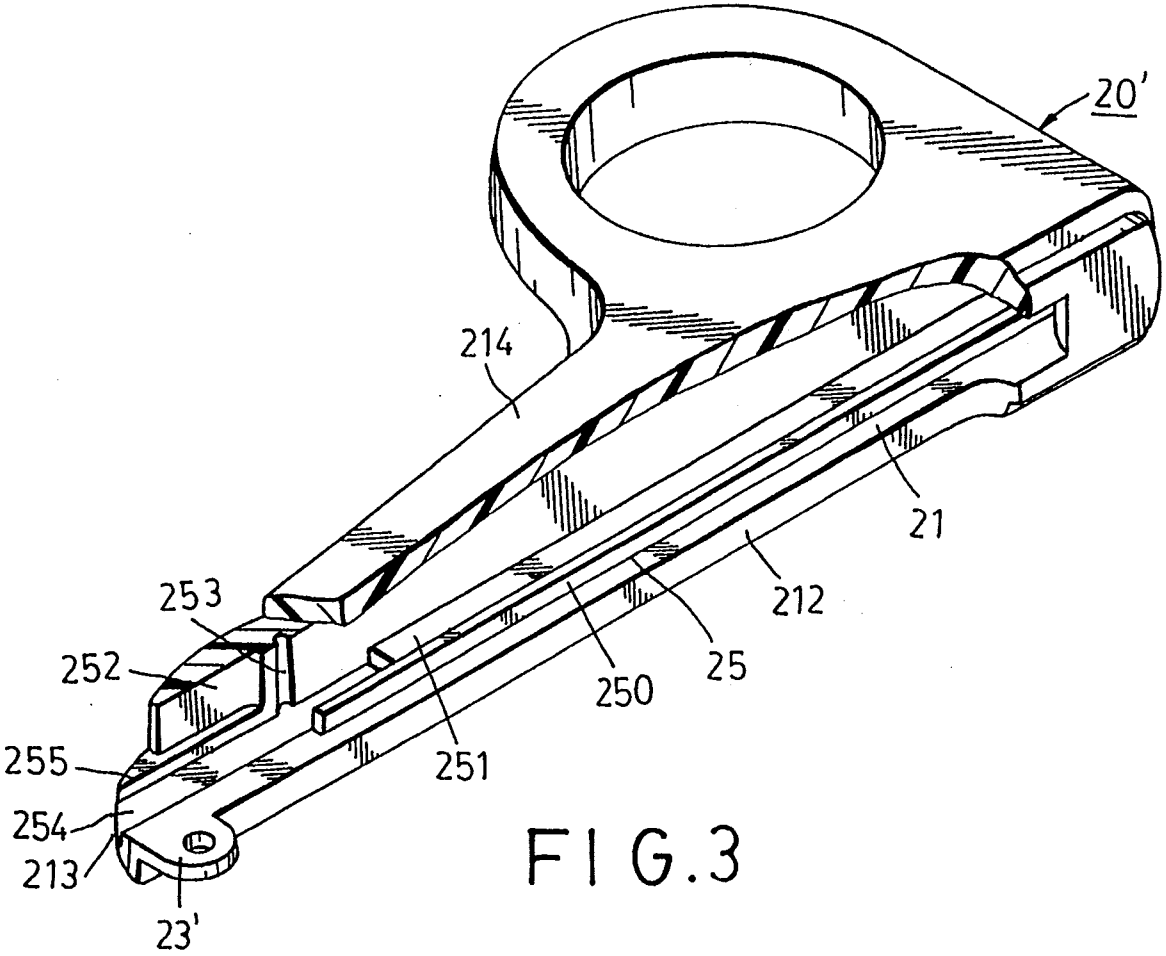
FIG. 3 is an enlarged, partially cutaway perspective view of one of the loop handles of the preferred embodiment.

Each of the loop handles 20, 20' is molded from plastic and has an outer portion, a substantially straight inner portion 212 opposite to the outer portion, and opposite sides 214. Referring to FIGS. 2 and 3, the inner portion 212 of each loop handle 20, 20' is formed with a recess 21 which extends longitudinally from a front end 213 of the loop handle 20, 20' to a point adjacent the rear end of the latter. Each of the opposite sides 214 of the loop handles 20, 20' has an outer surface that is formed with a respective longitudinal projecting strip 215 extending from the front end 213 of the loop handle 20, 20' to a point adjacent the rear end of the loop handle 20, 20' and that is further formed with a first rounded protrusion 22 aligned with the projecting strip 215 and disposed between a rear end of the projecting strip 215 and the rear end of the loop handle 20, 20'. A retaining unit 25 is provided in the recess 21 and is formed integrally with the loop handle 20, 20'. The retaining unit 25 includes a longitudinal guide projection 250 which is spaced from the outer portion of the loop handle 20, 20' so as to define a longitudinal rail groove 251 therewith. The rail groove 251 has a wider portion 252 adjacent to the front end 213 of the loop handle 20, 20'. The outer portion of the loop handle 20, 20' has an inner surface which faces the guide projection 250 and which is formed with a positioning groove 253 at the wider portion 252 of the rail groove 251. The wider portion 252 of the rail groove 251 has a groove bottom which is formed with a longitudinal recess 254. The outer portion of each loop handle 20, 20' is formed with a notch 255 at the front end thereof.

The inner portion 212 of the loop handle 20 is further formed with a pair of aligned first pivot ears 23 which project from the front end 213 thereof on two sides of the recess 21. Each of the first pivot ears 23 has an outer surface 230 that is flush with the outer surface of a respective one of the opposite sides 214 of the loop handle 20, and an inner surface 231 that is indented with respect to the inner surface of the respective one of the opposite sides 214 of the loop handle 20. The inner surface 231 has an inclined edge portion 232. Each of the first pivot ears 23 is formed with a through hole 233.

The inner portion 212 of the loop handle 20' is further formed with a pair of aligned second pivot ears 23' which project from the front end 213 thereof on two sides of the recess 21. Each of the second pivot ears 23' has an outer surface 230' that is indented with respect to the outer surface of a respective one of the opposite sides 214 of the loop handle 20' to permit superposing of the inner surface 231 of one of the first pivot ears 23 thereon. Each of the second pivot ears 23' further has an inner surface 231' that is flush with the inner surface of the respective one of the opposite sides 214 of the loop handle 20'. Each of the second pivot ears 23' is formed with a pin hole 233' to be aligned with the through holes 233 of the first pivot ears 23.

Referring to FIG. 2, a connecting pin 24 is fitted in the through hole 233 of each of the first pivot ears 23 to connect pivotally the first and second pivot ears 23, 23'. The connecting pin 24 has a head portion 241 received in the through hole 233 and a pin portion 243 extending downwardly from the head portion 241. The head portion 241 is formed with a second rounded protrusion 240. The pin portion 243 is formed with an annular retaining flange 242 to prevent removal of the connecting pin 24 from the respective first pivot ear 23. The pin portion 243 has a distal end portion which extends into the pin hole 233' of the respective second pivot ear 23', thereby connecting pivotally the loop handles 20, 20'.

The cutting blades 30, 30' are superposed and have a combined thickness which is sufficient to permit retraction of the cutting blades 30, 30' into the recesses 21 of the loop handles 20, 20' when the scissor of the present invention is closed. Each of the cutting blades 30, 30' has a rear end which is formed with an extension 32. The extension 32 has an anchor projection 34, 34' which extends slidably into the rail groove 251 of the respective loop handle 20, 20'. Each of the cutting blades 30, 30' is further provided with a pivot hole 31 adjacent to the rear end thereof. A hollow blade connector 35, such as a hollow rivet, extends into the pivot holes 31 of the cutting blades 30, 30' to connect pivotally the latter.

Figure 5:
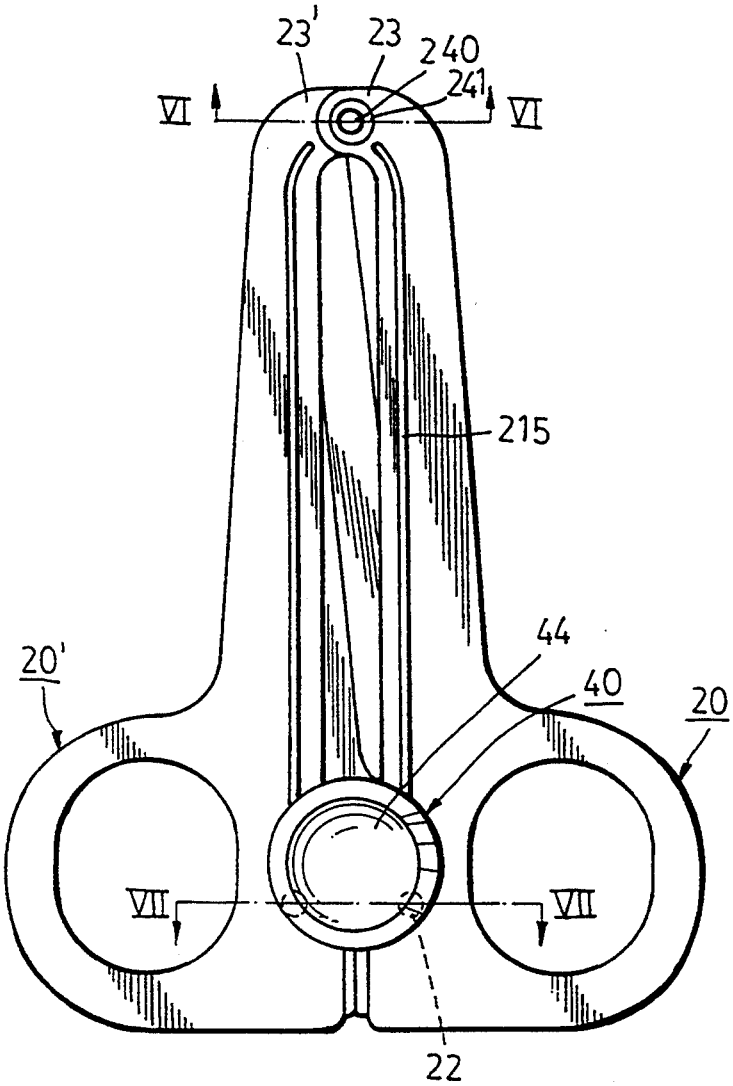
FIG. 5 is a schematic view of the preferred embodiment illustrating the cutting blades when retracted into the loop handles.
Figure 7:
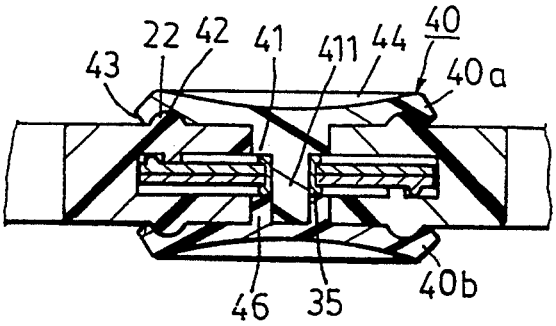
FIG. 7 is a sectional view of the preferred embodiment taken along line VII—VII in FIG. 5.

Referring again to FIG. 2, the slide unit 40 includes a pair of slide pieces (**40*a*, 40*b*), each of which being formed as a circular plate that rests slidably on a corresponding one of the opposite sides 214 of the loop handles 20, 20'. The slide piece (40*a*) has an inner side which is formed with an axial shaft projection 41. The shaft projection 41 has a diameter reduced distal portion 411. Referring to FIGS. 5 and 7, the inner side of the slide piece (40*a*) is further provided with an annular groove 42 around the shaft projection 41 and has an inclined peripheral edge 43. The slide piece (40*a*) further has a concave outer side 44. The slide piece (40*b*) is substantially similar to the slide piece (40*a*) in construction. The slide piece (40*b*), however, has an inner side which is formed with a tubular projection 46 that is adapted to receive fittingly the distal portion 411 of the shaft projection 41**.

Referring again to FIG. 2, each of the spring units 50 is formed as a resilient strip with a shorter portion 51, a longer portion 52 and a generally U-shaped portion which interconnects the shorter and longer portions 51, 52. Each of the spring units 50 is received in the wider portion 252 of the rail groove 251 of a respective loop handle 20, 20' and extends into the longitudinal recess 254 of the latter. The shorter portion 51 has a bent end section 511 which extends into the positioning groove 253 of the respective loop handle 20, 20'. The longer portion 52 has a curved end section 521, the purpose of which will be detailed in the succeeding paragraphs.

Figure 4:
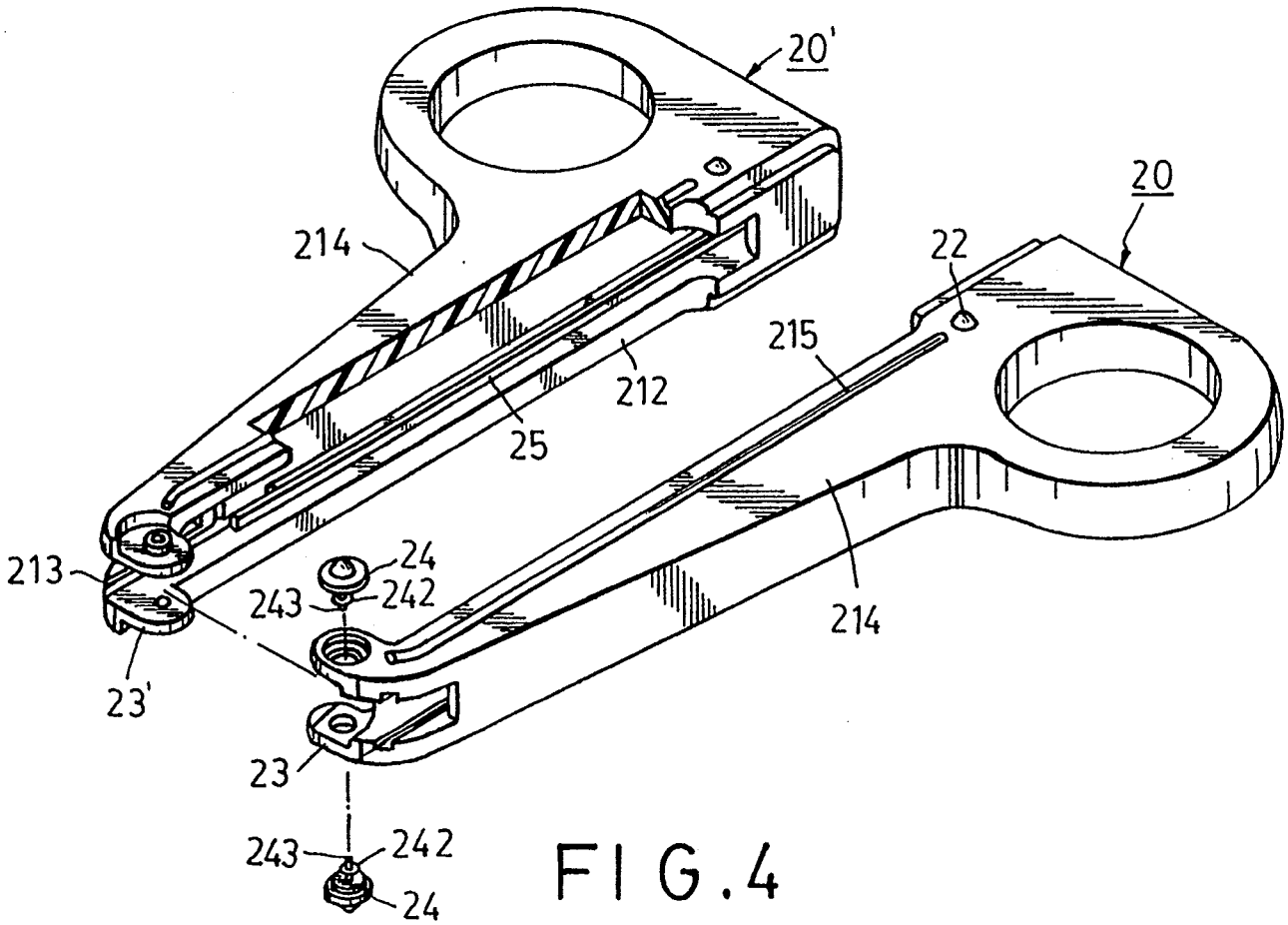
FIG. 4 is a perspective view illustrating how the loop handles of the preferred embodiment are connected pivotally.
Figure 6:
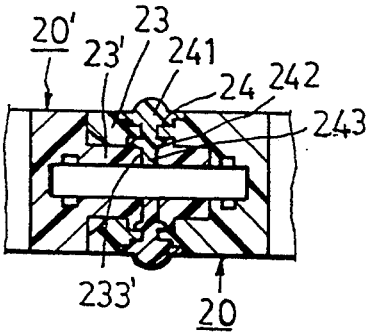
FIG. 6 is a sectional view of the preferred embodiment taken along line VI—VI in FIG. 5.

Assembly of the preferred embodiment is as follows: Referring to FIGS. 3, 4 and 6, when superposing the first and second pivot ears 23, 23', the first pivot ears 23 are spread apart by pulling at the inclined edge portions 232 of the same so that the distance therebetween becomes slightly greater than the distance between the second pivot ears 23', thus facilitating insertion of the second pivot ears 23', between the first pivot ears 23. The connecting pins 24, which are made of a resilient material, are then forced into the through hole 233 of the respective first pivot ear 23 such that the retaining flange 242 moves out of the through hole 233 and the pin portion 243 extends into the pin hole 233' of the respective second pivot ear 23'. At this stage, the loop handles 20, 20' are pivotable about the aligned axes of the connecting pins 24.

Referring to FIGS. 2 and 7, the cutting blades 30, 30' are superposed, and the blade connector 35 extends into the aligned pivot holes 31 of the cutting blades 30, 30' to connect pivotally the latter. The extensions 32 of the cutting blades 30, 30' are extended into the recess 21 of the respective loop handle 20, 20' such that the anchor projection 34, 34' thereon extends into the rail groove 251 of the respective loop handle 20, 20'. The slide pieces (40*a*, 40*b*) are disposed on the corresponding one of the opposite sides 214 of the loop handles 20, 20'. The shaft projection 41 of the slide piece (40*a*) extends between the inner portions 212 of the loop handles 20, 20' and the distal portion 411 of the same extends through the blade connector 35 and is received fittingly in the tubular projection 46 of the slide piece (40*b*). The inner sides of the slide pieces (40*a*, 40*b*) abut tightly against the projecting strips 215 on the loop handles 20, 20' at this stage.

Figure 8:
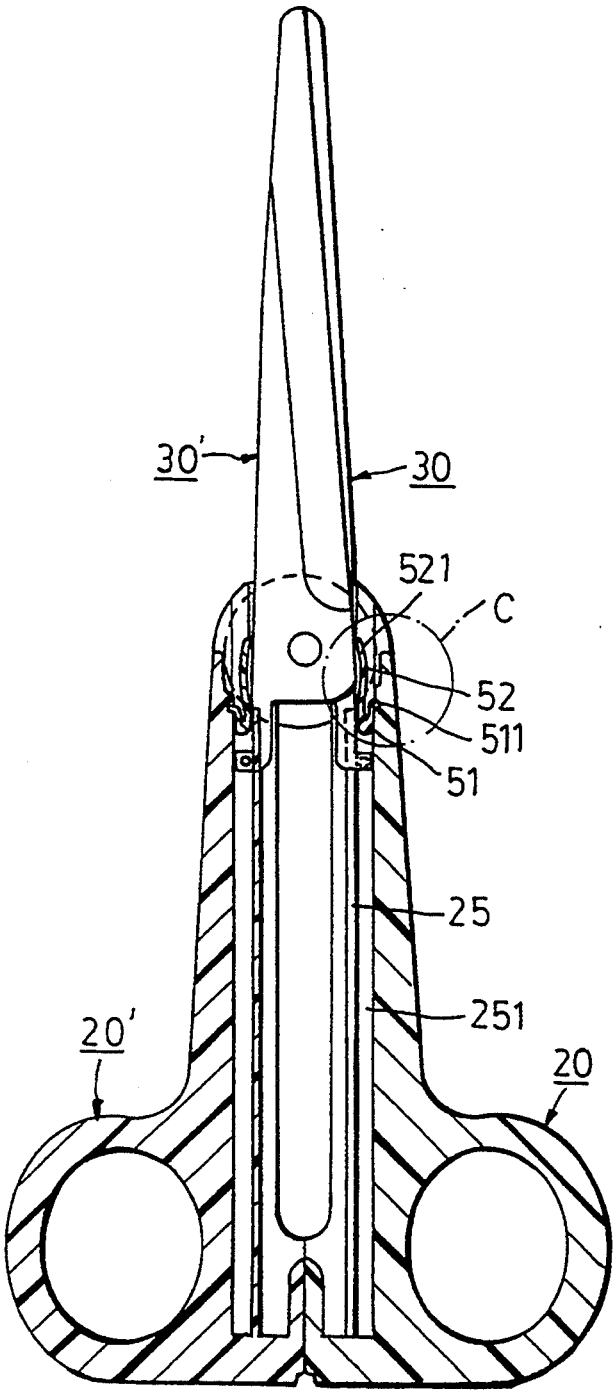
FIG. 8 is a sectional view of the preferred embodiment illustrating the cutting blades when extended from the loop handles.
Figure 9:
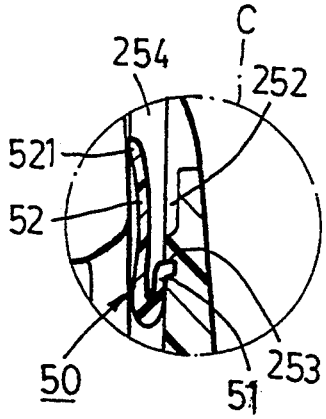
FIG. 9 is an enlarged view of an encircled portion (C) found in FIG. 8.

Referring to FIGS. 8 and 9, the spring units 50 are then inserted in the wider portion 252 of the rail groove 251 of the respective loop handle 20, 20' and extend into the longitudinal recess 254 of the latter. The bent end section 511 of the shorter portion 51 of the spring units 50 extends into the positioning groove 253 of the respective loop handle 20, 20', while the curved end section 521 of the longer portion 52 of the spring units 50 abuts against a dull edge of a respective one of the cutting blades 30, 30'.

Note that after assembly, the slide pieces (40*a*, 40*b*) are disposed on the projecting strips 215 of the loop handles 20, 20' and are not in direct contact with the opposite sides 214 of the latter, thereby facilitating smooth movement of the slide unit 40. Because the slide pieces (40*a*, 40*b*) are formed with inclined peripheral edges 43, the slide pieces (40*a*, 40*b*) are able to move past the first and second rounded protrusions 22, 240. To conceal the cutting blades 30, 30' in the recesses 21 of the loop handles 20, 20', the slide unit 40 is pushed toward the rear end of the latter until the first rounded protrusions 22 on the loop handles 20, 20' extend into the annular grooves 42 of the slide pieces (40*a*, 40*b*), thereby locking the cutting blades 30, 30' in the fully retracted position and preventing the loop handles 20, 20' from pivoting away from each other. This feature can prevent injury to small children playing with the present invention. Furthermore, the size of the scissor is reduced when the cutting blades 30, 30' are retracted, thus facilitating storage and bringing of the scissor of the present invention.

When it is desired to use the scissor of the present invention, the fingers of the user contact the outer sides 44 of the slide pieces (40*a*, 40*b*) to push the slide unit 40 toward the front end 213 of the loop handles 20, 20'. Because the slide pieces (40*a*, 40*b*) move along the projecting strips 215 on the loop handles 20, 20' little friction is encountered At the front end 213 of the loop handles 20, 20', the second rounded protrusions 240 of the connecting pins 24 extend into the annular grooves 42 of the slide pieces (40*a*, 40*b*), thereby retaining stably the cutting blades 30, 30' in the fully extended position.

Figure 10:
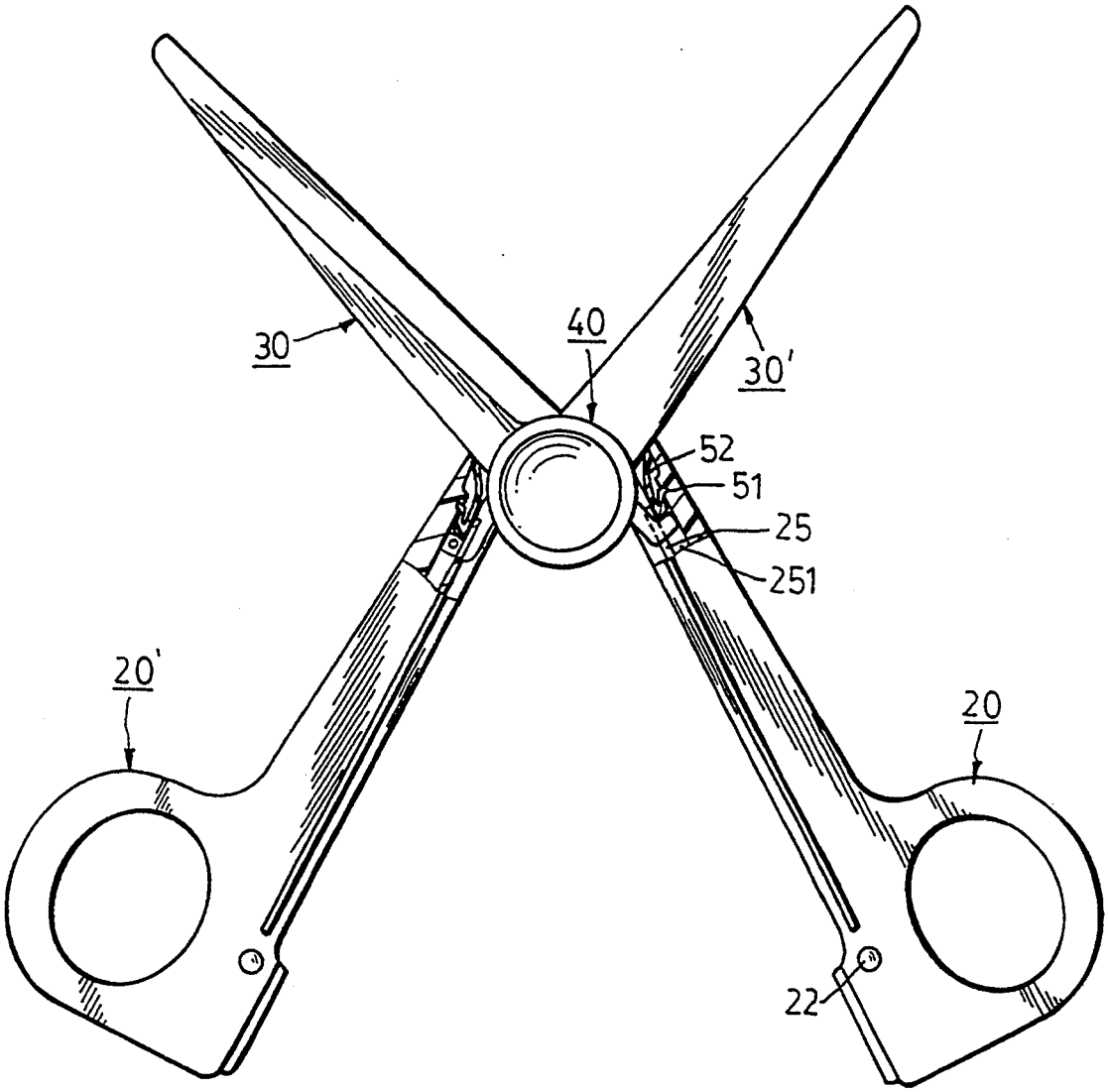
FIG. 10 is a schematic view of the preferred embodiment when opened.

Referring to FIGS. 8 and 10, the cutting blades 30, 30' pivot about the axis of the blade connector 35, which is disposed rearwardly of the aligned axes of the connecting pins 24. Thus, unlike most conventional scissors in which the cutting blades and the loop 15 handles pivot about the same axis, the loop handles 20, 20' and the cutting blades 30, 30' pivot about different axes. Therefore, the loop handles 20, 20' may be separated by a shorter distance in order to space apart the cutting blades 30, 30' by a farther distance when the scissor is in use. This facilitates handling and operation of the scissor. Referring to FIG. 10, when the loop handles 20, 20' are moved away from each other, the cutting blades 30, 30' extend into the notch 255 of the respective loop handle 20, 20', thereby preventing the loop handles 20, 20' from hindering opening movement of the cutting blades 30, 30'.

Referring once more to FIG. 8, when the scissor of the present invention is opened, the curved end section 521 of the longer portion 52 of each spring unit 50 is compressed by the dull edge of the respective cutting blade 30, 30'. After a cutting operation has been accomplished, the user may forget to move the loop handles 20, 20' toward each other so as to close the scissor. When the force that was applied so as to move the loop handles 20, 20' apart has been removed, the spring units 50 expand to force the cutting blades 30, 30' to pivot to the closed position, thereby causing corresponding movement of the loop handles 20, 20' toward one another. This illustrates how the safety features of the scissor of the present invention can be enhanced further with the inclusion of the spring units 50.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A scissor including a pair of handles, each of which having a front end, a rear end, and a substantially straight inner portion formed with a recess which extends longitudinally from said front end to a point adjacent said rear end, said pair of handles being connected pivotally at said front end, a pair of cutting blades in superposed contact with each other when said scissor is closed, said cutting blades being retractable into said recesses of said handles and being formed with aligned pivot holes adjacent to rear ends thereof, and a blade connector extending into said pivot holes of said cutting blades to connect pivotally said cutting blades, wherein the improvement comprises:

each of said handles having a retaining unit formed in said recess, said retaining unit including a longitudinal guide projection which defines a longitudinal rail groove in said recess, said rail groove having a wider portion adjacent to said front end, said inner portions of said handles facing each other and being formed with a respective pair of pivot ears on said front end, said pivot ears of one of said handles being superposed on said pivot ears of the other one of said handles, each of said handles further having opposite sides provided with a respective first rounded protrusion adjacent to said rear end;

a pair of connecting pins, each of which connecting pivotally one of said pivot ears on one of said handles and one of said pivot ears on the other one of said handles to connect pivotally said handles at said front end, each of said connecting pins having a head portion formed with a second rounded protrusion;

each of said cutting blades having a dull edge and being formed with an anchor projection at said rear end thereof, said anchor projection extending slidably into said rail groove of a respective one of said handles;

said blade connector being hollow;

a slide unit including two slide pieces, each of which resting slidably on a corresponding one of said opposite sides of said handles, one of said slide pieces being formed with a tubular projection, the other one of said slide pieces having a shaft projection which extends between said inner portions of said handles and through said blade connector and which is received fittingly in said tubular projection, each of said slide pieces having an inner side formed with an annular groove, said slide unit being movable between a first position, wherein said annular grooves receive removably said first rounded protrusions on said handles and said cutting blades are retracted into said recesses of said handles, and a second position, wherein said annular grooves receive removably said second rounded protrusions of said connecting pins and said cutting blades are extended from said recesses of said handles; and a pair of spring units, each of which being received in said wider portion of said rail groove in a respective one of said handles and having a curved end section which abuts against said dull edge of a respective one of said cutting blades to bias said cutting blades toward each other.

2. The scissor as claimed in claim 1, wherein each of said opposite sides of said handles is further provided with a longitudinal projecting strip that extends between said first and second rounded protrusions thereon, said slide pieces being disposed slidably on said projecting strips.

3. The scissor as claimed in claim 2, wherein said inner side of each of said slide pieces has an inclined peripheral edge.

* * * * *